United States Patent [19]

Knotts

[11] Patent Number: 5,022,107

[45] Date of Patent: Jun. 11, 1991

[54] BEACH MATTRESS

[76] Inventor: Richard A. Knotts, 1301 NW. 77 Way, Pembroke Pines, Fla. 33024

[21] Appl. No.: 437,342

[22] Filed: Nov. 16, 1989

[51] Int. Cl.[5] ..... A47G 9/06

[52] U.S. Cl. ..... 5/419; 5/420

[58] Field of Search ..... 5/417–420, 5/462

[56] References Cited

U.S. PATENT DOCUMENTS

| | | | |
|---|---|---|---|
| 1,222,563 | 4/1917 | Rosenberg | 5/419 |
| 4,329,747 | 5/1982 | Russell | 5/420 |
| 4,382,306 | 5/1983 | Lickert | 5/462 X |
| 4,681,195 | 7/1987 | Trahan et al. | 5/418 X |
| 4,726,084 | 2/1988 | Keserovich et al. | 5/417 |

*Primary Examiner*—Michael F. Trettel

*Attorney, Agent, or Firm*—George R. Royer

[57] ABSTRACT

The subject invention is a multiple purpose outdoor mattress comprising in general a longitudinally extending member of rectangular configuration, as viewed from an upper planar view, with a given thickness which extends from the bottom surface to the upper surface of the mattress. Formed downwardly from the upper surface to a distance just short of the lower surface of such mattress are a multiple number of pockets of parallelopiped or cylindrical configuration into which can be inserted any number or array of items for use by a person using such mattress. In an alternate arrangement, a separate member is affixed to the upper surface of such mattress, and such separate member has a plurality of openings depending downwardly into which can be inserted various objects.

2 Claims, 1 Drawing Sheet

BEACH MATTRESS

DESCRIPTION OF PRIOR ART AND BACKGROUND OF INVENTION

The subject invention pertains to the general art including all types of portable mattresses that are generally used outdoors to sunbathe or recline. The usual use of such mattresses is for sunbathing or general outdoor usage in which the user sits or reclines on the upper surface of such mattress.

The conventional portable mattress used for outdoor leisure and recreation embraces a general array of items ranging from a flat-type inflatable mattress to a filled fabrics, plastic-type arrangement. In general, in this prior art array, there are usually no added attributes to the mattress except for features like a pillow integrated to the mattress member, or in limited instances, carrying handles or other similar members used to secure the mattress in a rolled-up position or to a fixed chair.

In the prevailing usage of outdoor mattresses, people frequently recline in the open and sip beverages, smoke and often keep various personal items, such as radios, next or nearby to use and enjoy while reclining. No prior art portable mattress possesses the features of having integrated pockets or places into which such items may be stored temporarily for ready access, while the mattress is being used.

In light of the above, it is the primary purpose of the subject invention to provide an improved portable mattress which has a multiple number of pockets for indentations into which items can be placed for temporary storage in the mattress member, as an improvement over the existing state of the art. The following objects of the subject invention are directed accordingly.

OBJECTS

The following are objects of the subject invention:

It is an object of the subject invention to provide an improved portable mattress for outdoor usage;

It is also an object of the subject invention to provide an improved mattress;

Still another object of the subject invention is to provide an improved device for a person to recline upon for leisure usage;

It is also an object of the subject invention to provide an improved apparatus for enabling people to recline in the open with appurtenances on such apparatus to hold various objects;

Yet another object of the subject invention is to provide an improved outdoor recreational mattress;

Other and further objects of the subject invention will become apparent from a reading of the following description taken in conjunction with the drawings and claims.

DRAWINGS

DESCRIPTION OF GENERAL EMBODIMENT

The subject invention is a multiple purpose outdoor mattress comprising in general a longitudinally extending member of rectangular configuration, as viewed from an upper planar view, with a given thickness which extends from the bottom surface to the upper surface of the mattress. Formed downwardly from the upper surface to a distance just short of the lower surface of such mattress are a multiple number of pockets of parallelopiped or cylindrical configuration into which can be inserted any number or array of items for use by a person using such mattress. In an alternate arrangement, a separate member is affixed to the upper surface of such mattress, and such separate member has a plurality of openings depending downwardly into which can be inserted various objects.

DESCRIPTION OF PREFERRED EMBODIMENT

In describing the preferred embodiment of the subject invention, it is to be noted that the subject invention as described is only one embodiment of several within the scope of the subject invention. Therefore, the following description shall not be considered as limiting the scope of the invention as set forth in the following claims.

Figure 1:
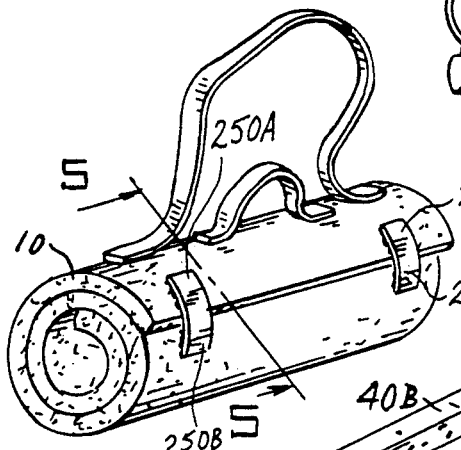
FIG. 1 is a perspective view of the subject apparatus in a rolled up status.
Figure 6:
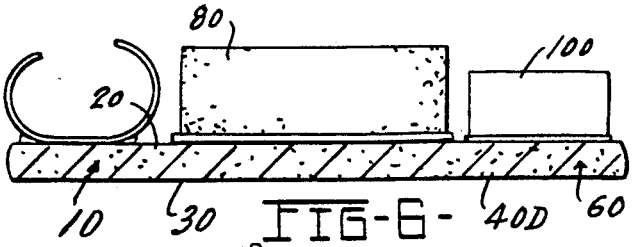
FIG. 6 is an end elevational view of the subject apparatus from the head end of the subject device.
Figure 2:
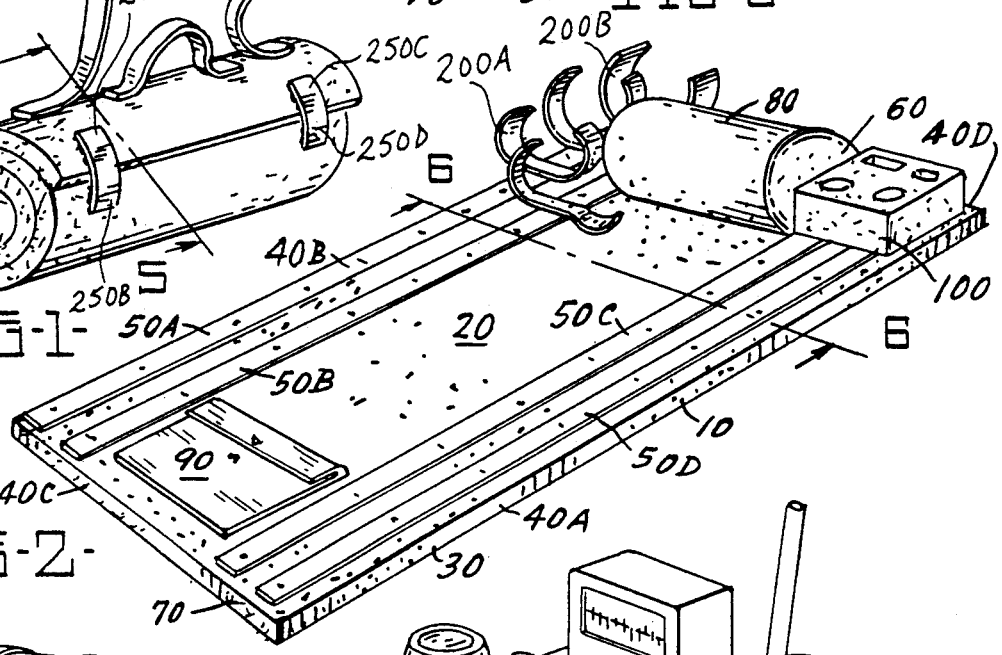
FIG. 2 is a perspective view of the subject apparatus shown in an extended horizontal position ready for use.
Figure 7:
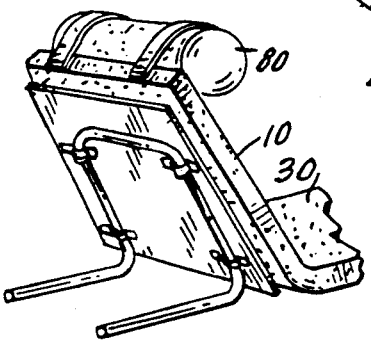
FIG. 7 is a perspective view of the subject apparatus set against a support so that it can be used as a recliner.

Attention is first addressed to FIGS. 2 and 6 of the drawings, and shown therein in a base mattress member 10 of generally flat disposition having an upper surface 20 of generally flat and rectangular configuration, and further having a bottom surface 30 of similar rectangular configuration. In general, in the preferred embodiment of the subject invention, the mattress 10 is generally a parallelopiped member having vertically disposed side edges 40A and 40B, and end edges 40C and 40D.

In the embodiment shown in FIG. 2, such mattress member 10 has a plurality of longitudinally extending strip members 50A, 50B, 50C and 50D disposed on the upper surface 20 and integrally formed or attached to such upper surface. Such strip members 50A, 50B, 50C and 50D are relatively thin members, as seen in FIG. 2. The mattress member 10 has a head end 60 and a foot end 70, as shown in FIG. 2. Attached to the upper surface 20 of the mattress 10 adjacent the head end 60, is a cylindrical pillow 80, although it must be noted that the pillow 80 may be of any configuration other than cylindrical. Integrally disposed in a flush manner is a carrying case bottom 90, adapted to hold papers or like objects.

As seen in FIG. 2, integrally affixed to the upper surface 20 of the mattress in the corner adjacent the intersection of side edge 40A and end edge is a holding appurtenance 100. Specifically, holding appurtenance 100 is preferably, although not necessarily, affixed next to pillow 80. However, it can be positioned in other locations on the mattress 10.

Figure 3:
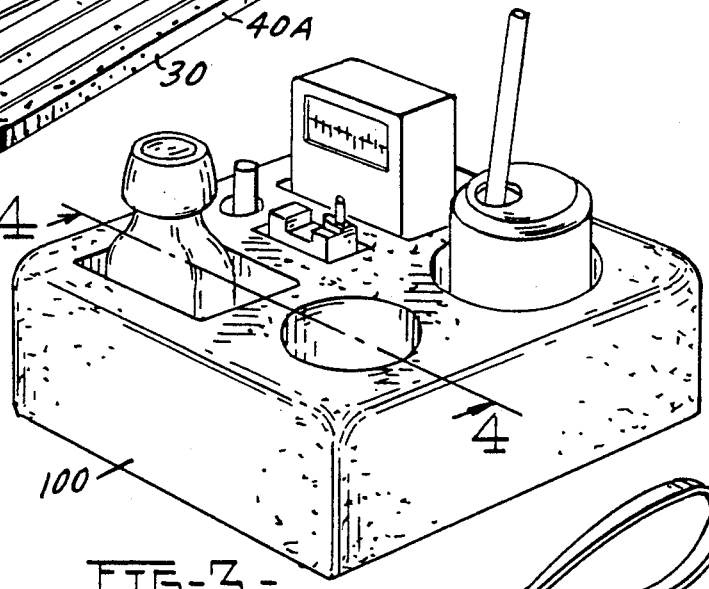
FIG. 3 is an upper perspective view of the attached holding appurtenance used to hold miscellaneous items.
Figure 4:
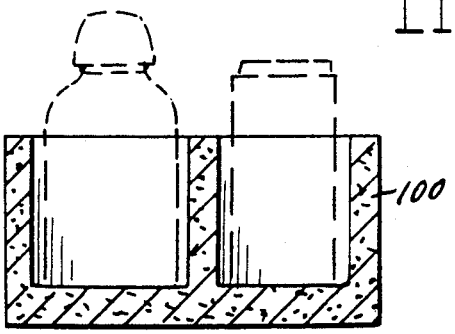
FIG. 4 is a side elevational view in section, of the holding appurtenance.
Figure 5:
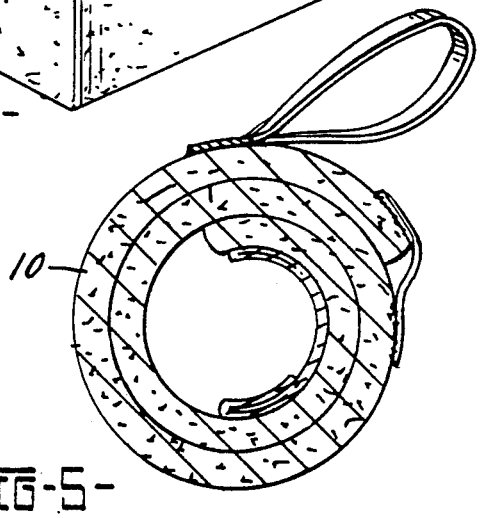
FIG. 5 is an end elevational view of the subject mattress in the rolled up position.

Attention is further directed to FIGS. 2, 3 and 4 which reveal the detail of the holding appurtenance 100, and in this respect, holding appurtenance 100 is basically a parallelopiped-shaped member having a height of a few inches, i.e., a thickness from its bottom surface to its upper surface 120, as seen. Formed into the holding appurtenance 100 from its upper surface downwardly are a plurality of depression 150A, 150B, 150C, 150D, 150E, and 150F. These depressions extend through the height of the holding appurtenance 100 to a depth just short of the bottom surface. As seen, these depressions 150A . . . 150E are of various shapes and sizes, with depressions 150A and 150B being cylindrical in order to hold cylindrical cans or bottles, while depressions 150C, 150D, 150E and 150F are rectangularly-shaped to hold appropriately-shaped rectangular objects, such as a small radio. These openings may vary in size and configuration.

Disposed on the opposite corner of the mattress 10 (i.e. the corner opposite to that corner on which the holding appurtenance 100 is located, and adjacent to the corner formed by the side edges 40B and end edge 40D) are mating strap members 200A and 200B, which are adapted to hold newspapers.

Furthermore, located on the bottom of surface 30 of the mattress 10 are loop members 250A, 250B, 250C and 250D adapted to enclose the mattress.

I claim:

1. A portable mattress member adapted for holding a person thereon in either a reclining position or other position, such member comprising a rectangularly-shaped member having an upper surface and a lower surface, and wherein said mattress member has an attached member with a plurality of indentations into the depth of such attached member said indentation formed to hold objects therein, said mattress member having a plurality of fastener strips on the upper surface thereof, and wherein said mattress member has a plurality of mating straps on one portion of said upper surface thereof which are structured to be tied together to hold objects thereon.

2. A beach mat comprising:

(a) a longitudinally extending mattress member having an upper surface and a lower surface, and wherein said upper surface of said mattress member has a plurality of fastener strips, extending longitudinally along the upper surface of said mattress member, and wherein said mattress member has a cylindrically-shaped pillow member integrally affixed to the upper surface of said mattress member, and wherein said mattress member has at least one pair of mating strap members structured to the tied together to hold objects affixed to said upper surface;

(b) attachment means adapted to be affixed on said upper surface, said attachment means having one or more indentations thereon, said indentation means adapted to hold objects herein;

(c) securing loop means affixed to the lower surface of said mattress member adapted to enclose said mattress member in a rolled configuration.

* * * * *